United States Patent [19]

Kempter

[11] 4,225,222

[45] Sep. 30, 1980

[54] PRINTING DRUM FOR AN ELECTROSTATIC IMAGING PROCESS WITH A DOPED AMORPHOUS SILICON LAYER

[75] Inventor: Karl Kempter, Munich, Fed. Rep. of Germany

[73] Assignee: Siemens Aktiengesellschaft, Berlin & Munich, Fed. Rep. of Germany

[21] Appl. No.: 952,066

[22] Filed: Oct. 17, 1978

[30] Foreign Application Priority Data

Oct. 19, 1977 [DE] Fed. Rep. of Germany ..... 2746967

[51] Int. Cl.[3] ..... G03G 5/082; G03G 15/30

[52] U.S. Cl. ..... 355/3 DR; 430/57; 430/95; 430/133; 430/136; 430/135; 148/174; 148/175; 427/39

[58] Field of Search ..... 430/84, 57, 95; 148/174, 175; 355/3 R, 3 DR

[56] References Cited

PUBLICATIONS

Chirtick, Journal of Noncrystalline Solids #3 1970, pp. 255–270.

Phys. Rev. 89 pp. 331–332 1953 Burstein.

Chemical Abstracts, vol. 73, 103304p 1970.

*Primary Examiner*—Dennis E. Talbert, Jr.

*Assistant Examiner*—John L. Goodrow

*Attorney, Agent, or Firm*—Hill, Van Santen, Steadman, Chiara & Simpson

[57] ABSTRACT

A printing drum is disclosed for electrostatic copying. The drum has a photo-electric-sensitive layer consisting of amorphous silicon advantageously containing hydrogen. The layer is designed to have a PN transition. A method is also disclosed for producing the layer by means of decomposition of a conveyed silicon-containing gas to which, if necessary, a gaseous doping material is added during a glow discharge in a heated printing drum.

2 Claims, 1 Drawing Figure

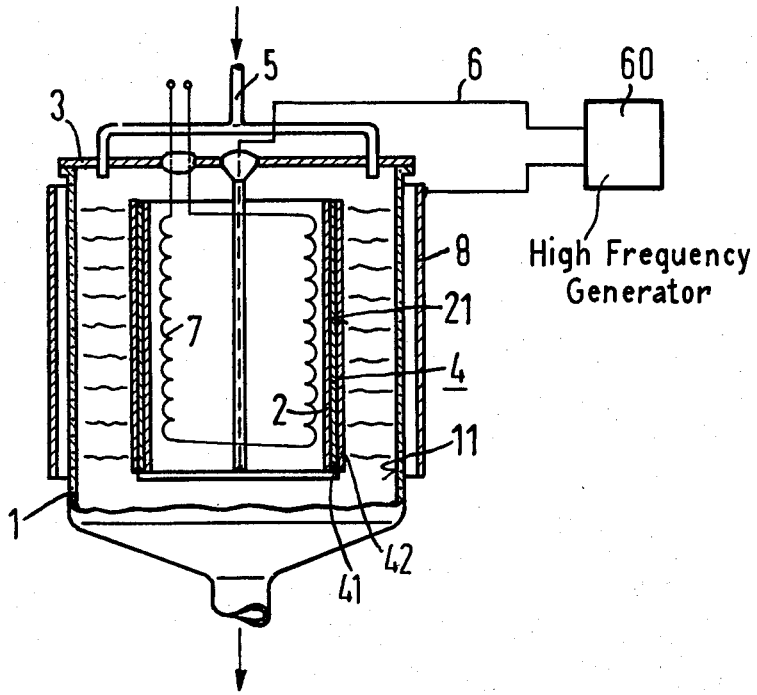
5
6
60
3
8
High Frequency
Generator
21
7
4
2
11
1
42
41

PRINTING DRUM FOR AN ELECTROSTATIC IMAGING PROCESS WITH A DOPED AMORPHOUS SILICON LAYER

BACKGROUND OF THE INVENTION

The invention relates to a printing drum for use in electrostatic photocopying methods. From the state of the art it is known to utilize printing drums for electrostatic photocopy methods. These printing drums have a surface layer consisting of light-sensitive, chargeable material such as selenium or chalcogenide glasses (arsenic-selenium alloys and compounds). It is also known to utilize organic photoconductors therefor, for example, PVK.

The printing drums mentioned are used to photograph an image of the pattern to be copied, which is projected onto the surface of the drum after a charge resulting from a corona discharge. This image is an electrostatic charge image, which by using a toner powder, subsequently is formed on a printing drum coated with printing ink. The actual printing process is is carried out by means of letting paper and a surface of the printing drum run one atop the other.

The following requirements result for devices of this known copying method. The material of the surface layer of the printing drum must have a high light sensitivity, and indeed in the spectral range of technologically conventional light sources. The material must have a specific electric impedance in darkness of magnitude $\rho \geqq 10^{12}$ ohm·cm. The material must also exhibit properties which remain unaltered with a continuous load, i.e. which operate in a fatigue-proof manner and which is sufficiently resistant to abrasion for the copying.

SUMMARY OF THE INVENTION

It is an object of the present invention to provide such a material for the surface layer of a printing drum which fulfills all the above-mentioned requirements together.

This object is inventively resolved with a printing drum which has a surface layer thereon comprising light-sensitive electrically chargeable amorphus silicon. In a preferred production method of such an inventive printing drum, the printing drum is situated in a receptacle having a counter-electrode arranged therearound. A low pressure glow discharge is maintained between the printing drum and the counter-electrode. A material containing silicon is introduced into the receptacle. This material decomposes under the effect of the glow discharge to create a deposition of silicon on a surface of the printing drum. The surface of the printing drum is preferably held at a temperature of between 20° C. and 350° C. during the deposition. The silicon, in particular, can be doped, whereby the conductance behavior is influenced in the known manner.

Some time ago the properties of amorphous silicon have already been examined relative to photoconductance and absorption. The invention builds on this knowledge. An exceptionally high-ohmic material having a specific impedance of up to $10^{14}$ ohm·cm is available with the amorphous silicon. If during the production, by means of depositing a layer of amorphous silicon on a substrate member, the surface temperature of said member is held at approximately 270° C., an amorphous silicon layer can be obtained which —as was determined —has an effectiveness of the photo current of 50%. A maximum effectiveness therefore lies in the range of a wavelength of approximately 600 nm. It is important that the electrons and holes in the silicon have an approximately equally greater movability in accordance with the invention. This condition in the invention is utilized to obtain a chargeable layer which exhibits practically no electric fatigue as has been known for years with the materials utilized.

Amorphous layers consisting of silicon have a great resistance to abrasion which is of great importance in conjunction with the invention. A printing drum of the invention has an increased life span.

DESCRIPTION OF THE PREFERRED EMBODIMENT

The symbol 1 characterizes a receptacle which can be evacuated with the aid of a pump, i.e. air atmosphere contained therein can be removed. The receptacle 1 can be sealed with a cover 3. A printing drum 2, to be provided with a layer according to the invention can be inserted into the receptacle 1 through the opening sealed with cover 3. 5 characterizes a system of feed lines through which a gaseous material such as, for example, hydrosilicon $SiH_4$ containing the element silicon and hydrogen can be inserted into the interior of receptacle 1.

In the space around the surface 21 of drum 2 in the interior of receptacle 1, a low pressure glow or luminous discharge is maintained. The printing drum 2 with its surface 21 is thereby used as the one electrode which is connected to a high frequency generator 60 via a high frequency feed line 6. Electrode 8 which, for example, is an envelope or sheathing consisting of electrically conductive material arranged about the outside of receptacle 1 and is used as the respective counter electrode. The glow discharge then burns in the interior of receptacle 1 between the surface 21 and the interior wall 11 of the receptacle. The pressure of the reaction gas, primarily of the hydrosilicon, is held at between 0.01 mbar and 2 mbar for the glow discharge. The electrical output of the glow discharge is apportioned such that no interfacing sputtering or scattering on the electrodes and/or the receptacle walls occurs. However, a decomposition of the added gas containing the silicon and hydrogen occurs, namely, a decomposition to an amorphous silicon having hydrogen included in the deposition. The decomposition is accordingly performed to such an extent that not all of the hydrosilicon molecules, for example, are completely decomposed. Rather, the decomposition is performed such that silicon atoms are still present to which individual hydrogen atoms are bound so that approximately 1 to 20 and preferably 10 atom percent of hydrogen content is present.

The surface of the printing drum 20 can be brought to a temperature of approximately 270° C., in particular, with the aid of a heating system schematically indicated and referenced 7. With the setting of the temperature, the amount of the hydrogen in the amorphously deposited silicon can be controlled.

Details of a deposition of amorphous silicon in a low pressure glow discharge can be concluded from "J. Non-Cryst. Sol.", Vol. 3 (1970), Page 255. A gas pressure of 0.05 to 5 mbar in the interior of the receptacle 1 is advantageous. A time length of approximately 1 to 5 hours is selected for the deposition of a sufficiently thick layer of the inventively provided silicon. A layer thickness in the range of 10 μm to 100 μm is advantageous for the inventively provided amorphous silicon.

A particular doping in an amorphous silicon layer produced according to the invention has a particularly advantageous influence. A doping is first undertaken during the deposit. This doping leads to a conductivity type of either N or P conductance. The doping material, preferably diborane for P conductance or preferably phosphine for N conductance is added and mixed as a gas to the supplied silicon in the gaseous $SiH_4$ supplied by pipe 5 in a corresponding amount of $10^{-4}$ to $10^{-1}$% by volume, for example, so that the layer portions 41, 42 of layer 4 are formed.

During the execution of the inventive method, i.e. during the forming of the hydrogen containing amorphous silicon layer deposited on the printing drum, one goes from a doping first carried out for one conductivity type to a doping for the other conductivity type by a change in the doping material. This change of the doping then leads to a P-N transition which is formed over practically the entire surface in the amorphous layer and parallel to the surface of the printing drum. Therefore, an increase of the electric impedance of the layer is obtained for the operating situation in which the polarity of the charging-up resulting from the corona-spraying leads to a blocking potential in the P-N transition layer (the P-N transition is operated in a blocking direction).

In a silicon layer according to the invention, doped as described above, the layer thickness on the printing drum can be made smaller.

The layer of the invention on the printing drum has the advantage that it can be exposed to relatively high temperatures in comparison to the state of the art without suffering any structural alterations.

A certain upper limit for the applied temperature is the value of the temperature at which the deposit of the silicon resulted on the surface 21. Advantageously, the crystallization temperature of the silicon lies at temperatures of approximately 1000° C.

Although various minor modifications might be suggested by those versed in the art, it should be understood that I wish to embody within the scope of the patent warranted hereon all such modifications as reasonably and properly come within the scope of my contribution to the art.

I claim as my invention:

1. An electrostatic photocopying printing drum comprising:

a drum having a photoelectrically sensitive surface layer thereon of light-sensitive electrically chargeable amorphous silicon, and the surface layer being doped so as to form two layers lying one atop the other, one of which is doped P conductive and the other N conductive so as to create a P-N junction running parallel to surfaces of the drum having the surface layer thereon.

2. A printing drum according to claim 1 in which the amorphous silicon of the layer contains hydrogen.

* * * * *